US005536150A

United States Patent [19]

Tucker

[11] Patent Number: 5,536,150

[45] Date of Patent: Jul. 16, 1996

[54] HYDRAULIC-PNEUMATIC STROKE REVERSAL SYSTEM FOR PUMPING UNITS, AND ITS APPLICATION IN PREFERRED EMBODIMENTS

[76] Inventor: Joe W. Tucker, 11413 Oak Knoll Dr., Austin, Tex. 78759

[21] Appl. No.: 281,600

[22] Filed: Jul. 28, 1994

[51] Int. Cl.[6] ..... F04B 9/10

[52] U.S. Cl. ..... 417/390; 417/398; 60/372; 60/476

[58] Field of Search ..... 417/379, 390, 417/398; 60/476, 372

[56] References Cited

U.S. PATENT DOCUMENTS

| | | | |
|---|---|---|---|
| 2,956,511 | 10/1960 | Morehead | 417/362 |
| 4,099,447 | 7/1978 | Ogles | 60/372 |
| 4,114,375 | 9/1978 | Saruwatari | 60/372 |
| 4,347,049 | 8/1982 | Anderson | 60/372 |
| 4,406,597 | 9/1983 | Stanton | 60/372 |
| 4,762,473 | 8/1988 | Tieben | 60/372 |
| 5,145,332 | 9/1992 | Bohon | 417/390 |

*Primary Examiner*—Richard A. Bertsch
*Assistant Examiner*—Roland G. McAndrews, Jr.

[57] ABSTRACT

This pumping unit stroke reversal invention can be employed in various embodiments, and uses one or more resilient hydraulic-pneumatic accumulators which slow and stop each stoke, storing the kinetic energy, and returning this energy to begin and accelerate the next succeeding stroke. This storing and re-application of energy greatly increases the efficiency of any pumping unit which incorporates the stroke reversal system of this invention. Counterbalance force is mechanical, hydraulic-pneumatic, or a combination of the two, and is applied in linear or rotary fashion. Drive power is applied during the larger central portion of each stroke, either mechanically or hydraulicly, and in either linear or rotary fashion, and the drive mechanism is then passive during the remaining, reversal portions of the stroke cycle. Pumping units incorporating the subject reversal system are uncomplicated, with a small number of total components, and some embodiments are totally controlled by a single three-position hydraulic valve which can be mechanically operated. Stroke reversal occurs at the instant of maximum rod stretch and maximum rod contraction, respectively, thereby eliminating parasitic rod string oscillation due to reversal, and permitting a higher stroke velocity and increased production from a unit of a given size. A further increase in efficiency is achieved by the smaller drive motor which is sufficient because movement of the system is begun and accelerated by the reversal accumulator.

21 Claims, 8 Drawing Sheets

HYDRAULIC-PNEUMATIC STROKE REVERSAL SYSTEM FOR PUMPING UNITS, AND ITS APPLICATION IN PREFERRED EMBODIMENTS

FIELD OF THE INVENTION

This invention relates in general to pumping units which employ various methods to utilize the kinetic energy from the deceleration and stopping of each stroke to begin and accelerate the next succeeding stroke, and specifically to prior pumping units which might employ hydraulic-pneumatic systems for this purpose.

This invention also relates indirectly to counterbalance mechanisms which exert a relatively constant force throughout the stroke cycle, and to drive mechanisms which function during a large central portion of each stroke, and are passive during the remaining, reversal portions of the stroke cycle, inasmuch as the subject reversal mechanism, in some embodiments of the invention, is interconnected with the counterbalance and/or drive mechanisms.

BACKGROUND OF THE INVENTION

The prior art includes a very large number of patents dealing with both mechanical and hydraulic pumping units, and a considerable number of the mechanical types employ some sort of mechanism to utilize the kinetic energy from deceleration and stopping of each stroke for beginning and accelerating the next stroke. To date the prior art has not shown us a satisfactory hydraulic or hydraulic-pneumatic method for this transfer of energy from one stroke to the next.

The walking beam pumping unit, by far the most popular and successful unit for many years, performs a very smooth reversal and is efficient at transferring the kinetic energy from each stroke to the next. Its motor functions constantly, which is advantageous, but there are power peaks due to the rotary drive connection to the beam, which is a disadvantage, and requires a larger motor.

The problem of parasitic rod string oscillation is pronounced in the walking beam unit, and its stroke velocity must be restricted to minimize the effects, and at the same time limiting production.

The large gearbox required to drive the reciprocating beam is a major drawback, and the mechanics of the system seem to generally limit its stroke length to less than twenty feet. For these reasons there have been many attempts by inventors and others associated with the production industry to produce a pumping unit in which power is applied more linearly, eliminating the beam and large gearbox, and in which a longer stroke and higher stroke velocity are easily accommodated.

These prior designs are mechanical, hydraulic, or a combination of the two, and are varied. Many have some good features, but all have shortcomings.

Most obvious among these shortcomings is the absence of an efficient stroke reversal mechanism in combination with a linear drive mechanism which provides a constant velocity for the remainder of the stroke cycle, eliminating power peaks and allowing a small, and therefore efficient, motor.

None of the designs within the field of the present invention incorporates features which eliminate parasitic rod string oscillation due to stroke reversal. All of these prior pumping units cause the reversal of the polish rod and upper end of the rod string with little regard for the current forces upon the lower end of the rod string due to rod stretch and inertia, which results in the upper end of the rod string reversing from upward to downward movement while the lower end of the rod string is still moving upward, and, respectively, reversing from downward movement to upward movement at its upper end while its lower end is still moving downward.

Many of the prior art pumping units, particularly the totally hydraulic ones, have a large number of control components, and many have special components which are difficult and expensive to manufacture.

Most prior hydraulic units have no stroke reversal capability, and they waste the kinetic energy of each stroke, thus requiting a larger motor to begin the next stroke from a dead stop.

Additionally, many pumping units of the prior art use solid state control devices, which presents a problem because of the possibility of damage to them due to power surges or electrical storms.

SUMMARY OF THE INVENTION

The stroke reversal system of this invention comprises a counterbalance system which applies an approximately constant counterbalance force throughout the stroke cycle, and a drive system which applies a constant velocity power force during the major central portion of each stroke, and is passive during the remaining reversal portions of the stroke cycle.

Counterbalance systems as described above are well known in the patent art, and as used in the present invention, can be hydraulic-pneumatic or mechanical, or a combination of the two.

The drive system of the subject invention can be mechanical, as by a mechanically powered sprocket, or hydraulic. Hydraulic application can be linear, as by a cylinder powered by a hydraulic pump, or rotary, as by a rotating hydraulic motor powered by a hydraulic pump. Drive systems which operate during a central portion of the stroke and are passive during a reversal phase are known in the art.

The subject stroke reversal mechanism can be totally or partially isolated from the drive and counterbalance systems, or it can be integrated with the drive system when the drive system is hydraulic, or it can be integrated with the counterbalance system when the counterbalance system is partially or totally hydraulic-pneumatic.

Eight pumping unit embodiments incorporating the present stroke reversal invention are shown in the Drawings and described in the Detailed Description. These embodiments are intended to illustrate several different methods of application of the present stroke reversal system invention, but are not intended to be restrictive, as other combinations of the components are possible.

Every embodiment of the present invention comprises at least one hydraulic circuit in which fluid travels in step with movement of the pumping unit mechanism and the polish rod assembly. This circuit is such in each embodiment that halting the flow of fluid stops movement of the pumping unit, and such that the forced movement of the fluid within the circuit causes movement of the pumping unit.

Stroke reversal is accomplished in each embodiment by the closing of a valve, which causes the above mentioned fluid, which moves in step with movement of the pumping unit, to now move into a relatively small accumulator, in which pressure builds rapidly, slowing and stopping the movement of the fluid, and therefore stopping movement of the pumping unit. The pressurized gas in the accumulator then releases its stored energy by beginning movement of the fluid and the pumping unit, then accelerating it, in the reversed direction, and the valve is then opened. This reversal process is triggered by control apparatus at the end portion of each upstroke and each downstroke.

The drive system used with the subject reversal invention, whether mechanical or hydraulic, operates during a large central portion of each stroke and is passive, causing little resistance to movement, during stroke reversal. The drive system is actuated in each stroke just as the system is brought almost up to speed by the returned energy from the deceleration and stopping of the previous stroke.

This drastically reduces the requirement for a power output peak from the motor which would have been required to begin movement of the system from dead still, and it therefore permits the use of a smaller motor which is better matched to the constant velocity and constant, smaller loading of the large central portion of the stroke.

This transfer of the reversal energy which is lost in prior pumping unit designs, and the use of a smaller motor which is matched to an almost constant loading, together add up to a very substantial energy saving and a much more efficient unit.

The incorporation of the subject stroke reversal mechanism in the pumping unit design actually lowers the total number of components and reduces the complexity of the controlling apparatus in respect to other hydraulic type pumping units which do not possess a stroke reversal capability.

Pumping units utilizing the subject reversal system require no more than two open/closed valves and a start/stop/reverse control for the drive motor or pump, to handle complete operational cycling control of the unit, and some embodiments require only a single, three-position hydraulic valve.

When driving force is applied mechanically and directly to the support sprocket, the characteristics of the design are such that the gear reducer which is used requires a reduction ratio of no more than six to one, which can be furnished by an uncomplicated single reduction gearbox. For some lighter duty mechanically driven pumping units with a relatively high polish rod velocity, a direct V-belt connection from the drive motor to the support sprocket shaft is possible.

Control of the two reversal valves and the motor, or of the single control valve, can be handled mechanically, and stroke length, timing of the engagement of drive force, and duration and intensity of stroke reversal force are all easily adjusted in the field.

Stroke reversal automatically occurs at the end of the down stroke at the instant of greatest load exerted upon the pumping unit by the rod string, which is the instant of maximum stretch in the rod string, just before it would begin to contract.

Its contraction is delayed, and spread out during a large part of the ensuing upstroke, because the forceful beginning of the upstroke by the subject reversal mechanism is initiated at that exact time.

Conversely, upstroke reversal automatically occurs at the point of the least load on the unit and maximum contraction of the rod string, and the rod string does not quickly stretch and erase the contraction because of the downward acceleration which the reversal mechanism imparts to its upper end to begin the down stroke, at the exact time of upstroke reversal.

The end result of these automatic reversals at the points of least and greatest loading of the polish rod is that at both upstroke and downstroke reversals, the entire rod string reverses at exactly the same time, which totally eliminates the development of parasitic oscillations in the rod string due to stroke reversal.

The timing of the beginning and end of the application of drive force in the central portions of respective strokes is adjusted to further enhance stroke characteristics, as is adjustment of the duration, timing, and intensity of stroke reversal; drive force is not necessarily adjusted to end exactly at the beginning of reversal, nor begin exactly at reversal's end, nor are downstroke reversal and upstroke reversal control characteristics necessarily identical.

By virtue of the operation of the subject stroke reversal system, and because of this control of rod string oscillation, control of reversal force and duration, and control of the period of drive engagement, it is possible to operate pumping units with the subject reversal system at a substantially higher stroke rate, without undue stress on, or damage to, the rod string, than is possible with prior pumping units.

Competition in today's oil industry demands pumping units that are simple to manufacture, maintain, and operate, that deliver a high output for a given size unit, and that are extremely energy efficient.

It is the object of this invention to make possible pumping units which satisfy the industry demands of the paragraph above, to overcome the previously listed objections to pumping units of the prior art, and to furnish numerous other advantages.

DETAILED DESCRIPTION OF THE DRAWINGS

Figure 1:
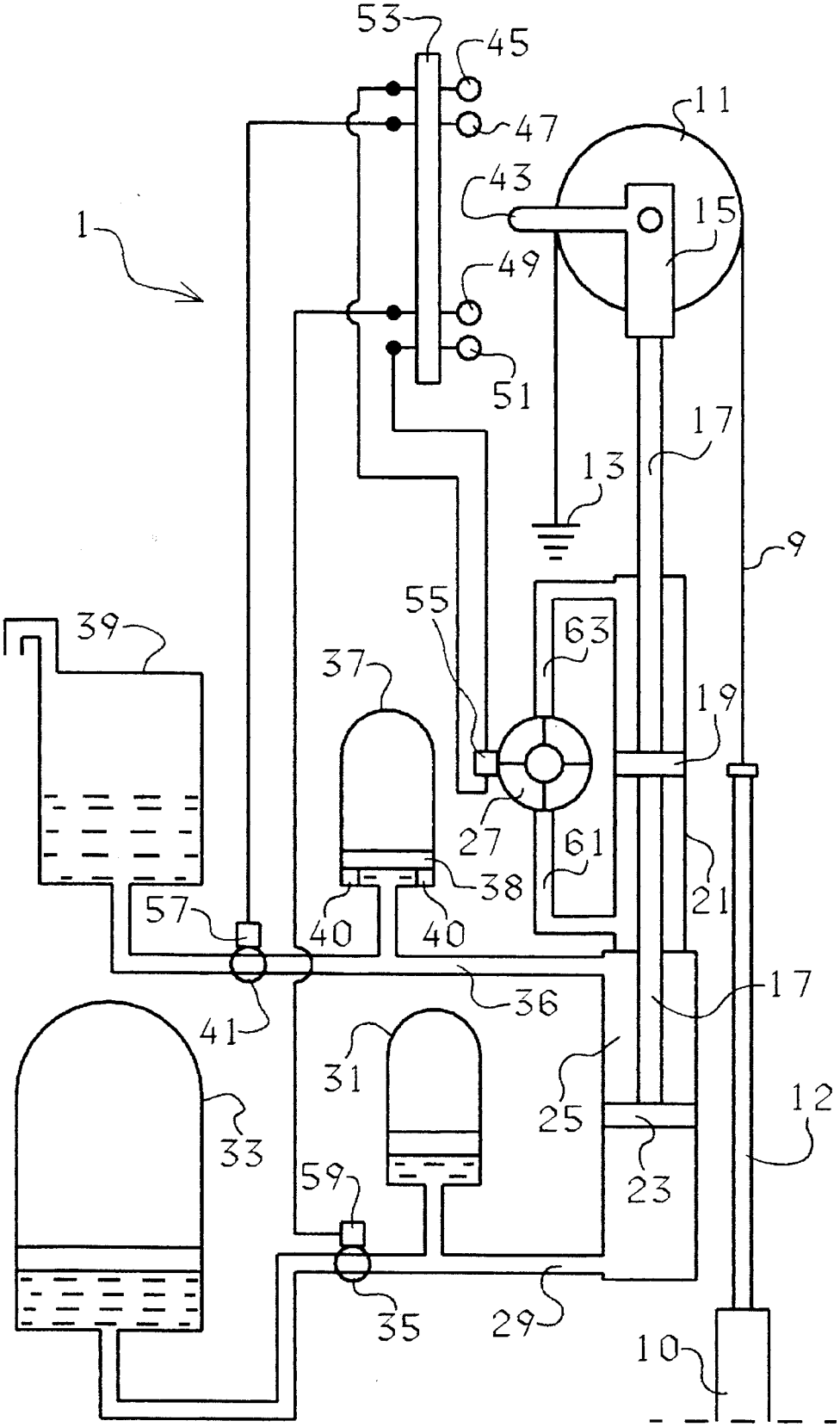
FIG. 1 is a schematic drawing of pumping unit 1, which comprises the subject stroke reversal system.

Pumping unit 1 comprises one embodiment of the subject stroke reversal invention, and is shown in schematic form in FIG. 1. Wellhead 10 is shown with polish rod 12, which is suspended by elongated flexible member 9. Flexible member 9 is trained over lift pulley 11 and attached to the framework at 13. Lift pulley 11 is rotatably supported by yoke 15 which is attached to lift shaft 17, which has attached to it drive piston 19 in drive cylinder 21, and lift piston 23 in lift cylinder 25.

Hydraulic pump 27 is reversible and drives pumping unit 1, by means of hydraulic pressure upon drive piston 19, alternately in each direction. Pump 27 is operational only during a substantial central portion of each upstroke and downstroke, and is still connected but is passive, offering little resistance to movement during the remaining reversal portions of the stroke cycle. Pump 27 and its associated drive cylinder 21 are independent of the hydraulic-pneumatic balance and stroke reversal functions of pumping unit 1, which are interconnected and operate in connection with lift cylinder 25.

Conduit 29 connects the lower end of lift cylinder 25 to downstroke reversal accumulator 31 and balance accumulator 33, and incorporates downstroke reversal valve 35 positioned to control fluid flow to/from balance accumulator 33 only.

Balance accumulator 33 is at least several times the volume of lift cylinder 25, so that its fluid pressure output, applied to the underside of piston 23 in lift cylinder 25, changes little during cycling. Its output pressure is selected to counterbalance the weight of the rod string plus a portion of the weight of the fluid column of the well, so that drive force from pump 27 is required equally during the upstroke and the downstroke.

Conduit 36 connects the upper end of lift cylinder 25 to upstroke reversal accumulator 37 and fluid receptacle 39, and incorporates upstroke reversal valve 41 positioned to control fluid flow to/from receptacle 39 only. Upstroke reversal accumulator 37 is pre-charged with gas pressure which is unopposed during a large part of the stroke, and its piston 38 then rests against stop 40.

Control actuator 43 is carried by yoke 15 and reciprocates with lift shaft 17 and lift pulley 11, and contacts in turn switches 45, 47, 49, and 51, which are attached to support bar 53. Switches 45 and 51 are electrically or otherwise connected to pump control 55 for pump 27, switch 47 is connected to upstroke reversal valve control 57, and switch 49 is connected to downstroke reversal valve control 59.

Assuming that pumping unit 1 is in the middle of its upstroke as it is shown in FIG. 1, pump 27 is operational and applying a fluid pressure force to the underside of drive piston 19 through conduit 61, forcing lift shaft 17 and therefore polish rod 12 upward at a constant velocity.

Control actuator 43 then contacts switch 47 which, through valve control 57, closes upstroke reversal valve 41. Fluid in the upper end of lift cylinder 25 which is being forced to move into conduit 36, by the upward movement of piston 23, can no longer enter receptacle 39 at atmospheric pressure, but must now enter upstroke reversal accumulator 37, which exerts a preselected initial pressure against entry of fluid, and this pressure builds rapidly with the continuing entry of fluid.

Soon after its contact with switch 47, actuator 43 contacts switch 45, which, through pump control 55, deactivates pump 27, placing it in a mode to cause negligible resistance to movement. The velocity of the system has decreased only slightly at this point, but continues to decrease as pressure builds in upstroke reversal accumulator 37 as more fluid enters it.

A point is reached at which the kinetic energy of the upward movement of the system has been absorbed and stored by accumulator 37, and motion has been stopped. This stored energy is then returned to the system to begin downward movement and bring the system up to a velocity close to its maximum.

The resistance furnished by upstroke reversal accumulator 37 is resilient in nature, and is instantaneously responsive to changes in applied force. The exact instant of upstroke reversal, when fluid ceases flowing into accumulator 37 and begins to be forced out of accumulator 37 by its gas pressure, occurs at the instant of least downward resistance by shaft 17 and piston 23 to upward fluid pressure exerted by balance accumulator 33 upon the lower side of piston 23.

This instant occurs at the time of least tensional force in flexible member 9, and coincides with the instant of maximum contraction of the rod string. This beginning of the downstroke, at the instant that the rod string is at its maximum contraction, prevents the introduction of parasitic rod string oscillations due to the reversal process.

Returning to the explanation of the stroke cycle, actuator 43 then contacts switch 45, which through pump control 55 activates pump 27 to operate in a reverse direction, applying a fluid pressure through conduit 63 to the upper side of piston 19 in drive cylinder 21, to continue downward movement which was initiated by the energy stored in upstroke reversal accumulator 37.

Control actuator 43 at almost the same time contacts switch 47, which, through valve control 57, opens valve 41, allowing fluid to flow from receptacle 39 into the upper end of lift cylinder 25 as piston 23 moves downward.

Pump 27 operates at a consistent power output to move piston 19, lift shaft 17, and polish rod 12, along with the system's rod string, downward at a steady velocity until downstroke reversal is initiated by the contact of control actuator 43 with switch 49, which, through valve control 59, closes downstroke reversal valve 35.

The closure of valve 35 causes fluid which was flowing into balance accumulator 33, and in small part into downstroke reversal accumulator 31, from conduit 29, due to the downward movement of piston 23 in cylinder 25, to now flow solely into downstroke reversal accumulator 31.

Switch 51 is almost immediately contacted by control actuator 43, deactivating pump 27. Movement of the system is slowed and stopped by gas pressure buildup in downstroke reversal accumulator 31, and then started and accelerated in the reverse, upward, direction by the release of the stored energy in the pressurized gas confined in downstroke reversal accumulator 31.

Control actuator 43 then contacts switch 51 and switch 49 as it moves upward, activating pump 27 in the upstroke direction and opening valve 35 to allow fluid pressure from balance accumulator 33 to bear on the underside of piston 23 of lift cylinder 25, to balance the weight of the polish rod assembly plus part of the weight of the fluid column, throughout the remainder of the stroke. These latest functions place the system in the central portion of the upstroke, completing one full cycle of operation.

The downstroke reversal occurs at the instant of greatest weight upon polish rod 12 and greatest tension on flexible member 9, and this is also the instant of greatest elongation of the rod string. This timing of reversal is automatic because of the resilient nature of downstroke reversal accumulator 31, and prevents parasitic rod string oscillation due to the reversal process.

To recap, a complete cycle of operation is produced, beginning in the middle of the upstroke, by contact of control actuator 43 with: 1.) switches 47 and 45 to close valve 41 and deactivate pump 27; 2.) switches 45 and 47 to activate pump 27 in the other direction and open valve 41; 3.) switches 49 and 51 to close valve 35 and deactivate pump 27; 4.) switches 51 and 49 to activate pump 27 in a reversed direction and open valve 35.

The present embodiment of the invention is basic and sufficient for most applications. It is noted, however, that one or all of switches 45, 47, 49, and 51 might be split into double switches to separate their dual function. In this way, pump 27 might be de-activated at one point for a reversal, and re-activated at a slightly different point by a second switch, and valve 41 and/or valve 35 might be closed at one point and reopened by a separate switch at a different point along support bar 53 after reversal.

In actual application the upstroke reversal will differ somewhat from the downstroke reversal because of characteristics of the pumping operation which vary from upstroke to downstroke, as, for instance, fluid is moved only on the upstroke and rod string inertia is more of a factor on the down stroke reversal.

Stroke length is easily adjusted by changing the location of the switches upon support bar 53, shortening or lengthening the distance between switches 47 and 49.

Lift cylinder 25, with its piston 23 and lift shaft 17, functions as a hydraulic pump for the reversal process when fluid is being forced into downstroke reversal accumulator 31 or upstroke reversal accumulator 37 by the inertia of the moving polish rod assembly; it then functions as a hydraulic motor to begin movement in the reversed direction, as the gas pressure in accumulator 31 or 37 forces fluid back into cylinder 25.

Lift cylinder 25, in connection with its counterbalance function, during the level stroke velocity drive portion of the stroke, functions as a hydraulic pump during the downstroke, and a hydraulic motor during the upstroke.

The present embodiment of the invention offers ample control over operational characteristics of pumping unit 1: the size and pressure of balance accumulator 33 and reversal accumulators 31 and 37 are selectable and adjustable, as is the location of switches 45, 47, 49, and 51. The diameters and lengths of cylinders 21 and 25 are selectable by design, as is the output of pump 27.

Figure 2:
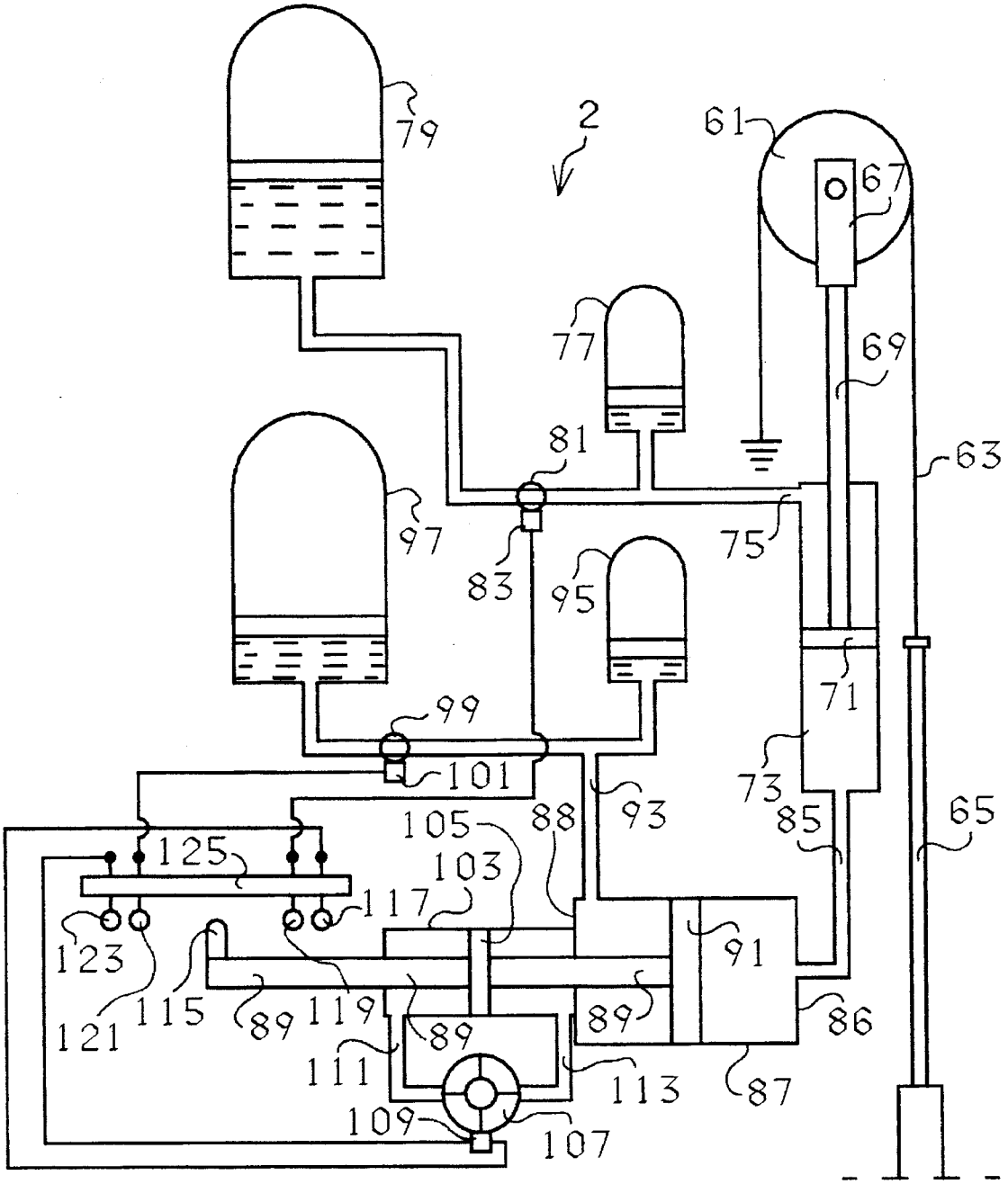
FIG. 2 is a schematic drawing of pumping unit 2, which comprises the subject stroke reversal system.

FIG. 2 shows pumping unit 2, and its embodiment of the present stroke reversal invention in schematic form. The drive, counterbalance, and reversal functions of pumping unit 2 are hydraulic or hydraulic-pneumatic, and the drive function is isolated, while the counterbalance and reversal mechanisms are intertwined.

Lift pulley 61 supports flexible member 63 which reciprocates polish rod 65. Yoke 67 rotatably supports lift pulley 61 and is attached to lift shaft 69 which has piston 71 in lift cylinder 73 attached to its lower end.

Conduit 75 connects the upper end of lift cylinder 73 to upstroke reversal accumulator 77 and reservoir accumulator 79, with valve 81, with its valve control 83, controlling the flow of fluid to/from reservoir accumulator 79 only. Reservoir accumulator 79 operates at a very low pressure, and its function is little different from that of reservoir 39 of pumping unit 1 of FIG. 1.

Conduit 85 connects the lower end of lift cylinder 73 to the transfer end 86 of balance/transfer cylinder 87, which has a shaft 89 supporting a piston 91. The balance end 88 of balance/transfer cylinder 87 is connected by conduit 93 to downstroke reversal accumulator 95 and balance accumulator 97, with valve 99 and its valve control 101 controlling fluid flow to/from balance accumulator 97 only.

Drive cylinder 103 has drive piston 105 attached to shaft 89, which is common to balance/transfer cylinder 87. Hydraulic pump 107, with its pump control 109, is connected to the ends of drive cylinder 103 by conduits 111 and 113, respectively.

Shaft 89 extends past the free end of drive cylinder 103 to support control actuator 115, which contacts, during its operational cycle, switches 117, 119, 121, and 123, which are secured to support bar 125.

Control actuator 115, valves 81 and 99, valve controls 83 and 101, pump 107 and its control 109, and switches 117, 119, 121, and 123 all operate in a fashion very similar to their counterparts of pumping unit I of FIG. 1, and the stroke characteristics of pumping units 1 and 2 are almost identical.

Balance accumulator 97 applies hydraulic pressure to the balance end 88 of balance/transfer cylinder 87, and this pressure is transferred mechanically through piston 91, and then hydraulically through conduit 85 to bear on the lower side of lift piston 71, its force transferred through lift shaft 69 and pulley 61 to balance the weight of the rod string and a part of the weight of the fluid column.

Pump 107 applies upstroke pressure to piston 105 in drive cylinder 103 through conduit 111, and downstroke pressure through conduit 113. These forces are respectively transferred mechanically by shaft 89 to piston 91 in balance/transfer cylinder 87, and thence hydraulically to piston 71 in lift cylinder 73, to become a component of the force transferred to polish rod 65 by way of lift shaft 69.

Upstroke reversal valve 81 is closed to cause all fluid displaced by upward movement of lift piston 71 to flow into upstroke reversal accumulator 77, which increases in a direct manner the hydraulic force on the upper side of lift piston 71 to effect reversal.

On the other hand, when the end of the downstroke approaches and downstroke reversal valve 99 is closed to cause reversal, the fluid which flows into downstroke reversal accumulator 95 is only indirectly supplied by the downward movement of lift piston 71, inasmuch as fluid from lift cylinder 73 flows through conduit 85, into the transfer end 86 of balance/transfer cylinder 87, where it causes a force against, and movement of, piston 91, which in turn forces fluid from the balance end 88 of cylinder 87 to flow into conduit 93 and thence to downstroke reversal accumulator 95.

The operational result of the downstroke reversal of pumping unit 2 is almost identical to that of pumping unit 1, as if piston 91 of pumping unit 2 were mechanically connected to lift shaft 69, as piston 23 of pumping unit 1 is connected to lift shaft 17.

Lift cylinder 73 and balance/transfer cylinder 87, insofar as the reveral and counterbalance functions are concerned, operate as a single cylinder, much like cylinder 25 of pumping unit 1 operates. Together, cylinders 73 and 87 operate as a hydraulic pump and then as a hydraulic motor during each stroke reversal, and as a pump during the powered portion of the downstroke and as a motor during the powered portion of the upstroke.

The volume of balance/transfer cylinder 87 is approximately equal to the volume of lift cylinder 73, but cylinder 87 can be of larger diameter and much shorter to minimize piston and seal wear by means of its shorter stroke.

Drive cylinder 103 must have the same stroke as cylinder 87, and it can also be relatively short to minimize wear, and its diameter is then determined by design working pressure of pump 107, along with anticipated maximum drive force required to be transferred by shaft 89.

We may assume that pumping unit 2 of FIG. 2 is in the central part of its upstroke, and shaft 89 and pistons 105 and 91 are moving from left to right in FIG. 2, and pump 107 is sending fluid under pressure through conduit 111 to exert driving force against piston 105.

Control actuator 115 then contacts switch 119, which, through valve control 83, closes upstroke reversal valve 81.

This causes all of the fluid being displaced by upward movement if piston 71 of lift cylinder 73 to begin to flow into upstroke reversal accumulator 77.

In a short time after the closing of valve 81, control actuator 115 contacts switch 117, which, through control 109, deactivates pump 107. Pressure builds in accumulator 77, motion is slowed and stopped, then started and accelerated in the downstroke direction. The unit gets almost up to speed, and control actuator 115 contacts switches 117 and 119, respectively, which activates pump 107 in the downstroke direction, and opens valve 81 to allow fluid from reservoir accumulator 79 to flow into cylinder 73 through conduit 75.

The unit is moved through the large, central, constant velocity portion of its downstroke by fluid pressure from pump 107 exerted upon piston 105, through conduit 113. Control actuator 115 then contacts switches 121 and 123, respectively closing valve 99 and deactivating pump 107.

Pressure builds in downstroke reversal accumulator 95 to stop and reverse movement, switches 123 and 121 are contacted in turn, and pump 107 forces fluid through conduit 111 for the powered portion of the upstroke.

Figure 3:
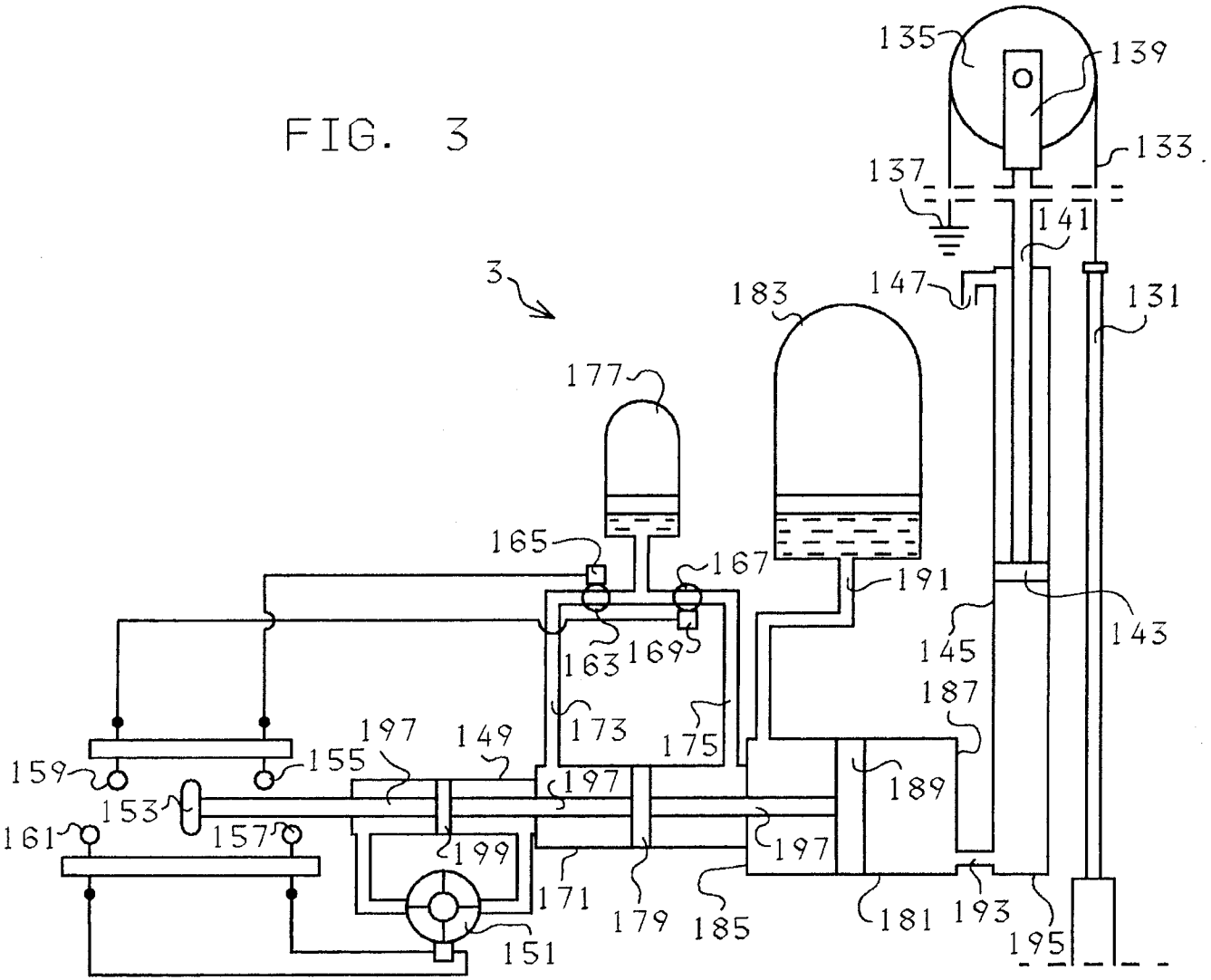
FIG. 3 is a schematic drawing of pumping unit 3, which comprises the subject stroke reversal system.

FIG. 3 shows pumping unit 3 of the subject stroke reversal invention in schematic form. The hydraulic systems of the drive, reversal, and counterbalance functions are isolated from each other.

Polish rod 131 is shown supported by flexible member 133, which is trained over lift pulley 135 with its end attached to the framework at 137. Yoke 139 rotatably carries lift pulley 135 and is attached to lift shaft 141 which carries lift piston 143 in lift cylinder 145 on its lower end.

Lift cylinder 145 may incorporate a breather 147 at its upper end, as it does not require fluid in its upper chamber.

The operation of drive cylinder 149, hydraulic pump 151, control actuator 153, switches 155, 157, 159, 161, and valves 163 and 167, is very similar to the operation of the corresponding components of pumping units 1 and 2. Only the differences between pumping unit 3 and units 1 and 2 will be detailed.

Reversal cylinder 171 has its two ends connected by conduits 173 and 175, respectively, to reversal accumulator 177, these conduits incorporating valves 163 and 167, respectively. Reversal piston 179 moves fluid into conduit 173 during the downstroke, and into conduit 175 during the upstroke.

During downstroke reversal, downstroke reversal valve 167 is closed, fluid is forced by way of conduit 173 into, and then is forced out of, reversal accumulator 177. During upstroke reversal, it is upstroke reversal valve 163 that is closed and fluid flows through conduit 175, to and then from accumulator 177.

During the large central portion of the upstroke and the downstroke, valves 163 and 167 are both open, and fluid is simply circulated through the loop of conduits 173 and 175. During this time, no fluid enters or leaves reversal accumulator 177. Accumulator 177 is placed as close as possible to cylinder 171, and conduits 173 and 175 are therefore short, and are also designed with as large a diameter as practical, in order to drastically limit friction during recirculation of fluid.

Reversal cylinder 171 functions as a hydraulic pump at the beginning of each stroke reversal, as it forces fluid under pressure into reversal accumulator 177, and then functions as a motor during the second half of reversal, as fluid is forced by gas pressure from accumulator 177 back into cylinder 179 to force movement of piston 179 and shaft 197.

This embodiment of the subject stroke reversal system offers advantages. The fluid pressure in the system before reversal is initiated can be selected by adjusting the gas pressure in reversal accumulator 177. The rate of pressure increases during reversal can be adjusted by changing the fluid volume in the system to increase or decrease the volume of accumulator 177 which is occupied by its pressurized gas.

Balance/transfer cylinder 181 is connected to balance accumulator 183 at its balance end 185 by means of conduit 191, and to lift cylinder 145 at its transfer end 187 by means of conduit 193. Fluid pressure from balance accumulator 183 is exerted upon the balance side of balance/transfer piston 189. Conduit 193 is short and relatively large, and the fluid pressure in the lower end 195 of lift cylinder 145 is almost identical to that in the transfer end 187 of balance/transfer cylinder 181 at all times. Common shaft 197 is common to drive cylinder 149 and its piston 199, reversal cylinder 171 and its piston 179, and balance/transfer cylinder 181 and its piston 189. The directionally variable and non-constant forces introduced into the system by drive cylinder 149 and reversal cylinder 171 are passed into shaft 197 by means of pistons 199 and 179, respectively, and thence passed mechanically into piston 189 of balance/transfer cylinder 181.

The unidirectional and almost constant force from balance accumulator 183, as indicated earlier, is passed hydraulically directly to piston 189 to add to the mechanical forces, above, passed into piston 189. The sum of these forces urges piston 189 in a direction to oppose the hydraulic force applied to piston 189 through conduit 193 from piston 143 of lift cylinder 145, due to the weight and inertia of polish rod 131 and the rod string and fluid column of the well.

The sum of all these forces which bear upon balance/transfer piston 189 changes often, resulting in the stroke cycle of pumping unit 3. The stroke cycle is designed and controlled by selection of components of the drive, reversal, and balance systems, and by adjustment of their various controlling factors.

Lift cylinder 145 of pumping unit 3 is approximately ½ the length of the stroke of pumping unit 3. Drive cylinder 149, reversal cylinder 171, and balance/transfer cylinder 181 must all have the same stroke length, which, however, can be much shorter than the stroke of lift cylinder 145.

The diameter of cylinders 149, 171, and 181 is selectable, and can easily be large enough to permit their respective, equal strokes to be one fourth that of lift cylinder 145. In this case their strokes would be one half times one fourth, equals one eighth, of the stroke of pumping unit 3, resulting in a tremendous reduction in the wear of, and increase of the life of, their pistons and seals.

Figure 4:
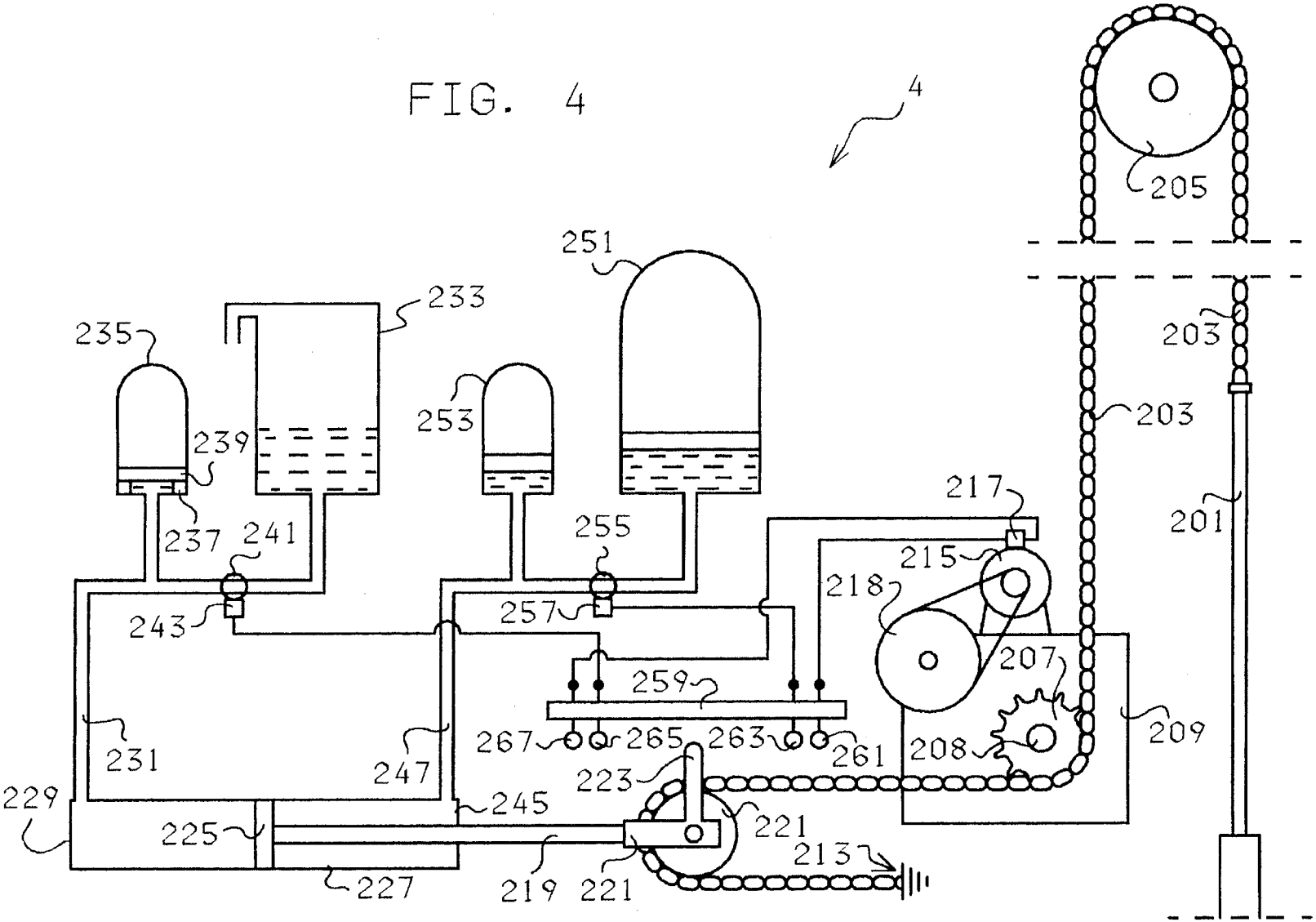
FIG. 4 is a schematic drawing of pumping unit 4, which comprises the subject stroke reversal system.

FIG. 4 shows pumping unit 4 of this stroke reversal invention in schematic form. Pumping unit 4 comprises a reversing mechanical drive system, along with a single lift cylinder, balance system, and reversal system which are almost identical to corresponding components of pumping unit 1 of this invention. The control system, operational control, and stroke characteristics of pumping unit 4 are also very similar to those of pumping unit 1, and will not be discussed here in detail.

Referring to FIG. 4, polish rod 201 is supported by drive chain 203, which is spooled over support pulley 205 which is rotatably supported by framework means. Drive chain 203 is then trained around drive sprocket 207 of gear reduction unit 209, and thence around lift pulley 211 and on to attach to framework at 213. Motor 215 drives gear reduction unit 209 through input pulley 218, and is started and stopped by motor control 217.

Motor 215 is direct connected and turns at all times. It is de-energized and offers little resistance to movement during stroke reversals. The 90° contact of drive chain 203 with drive sprocket 207 is deemed sufficient, but if required the components can be rearranged to provide 180° of contact.

Lift shaft 219 comprises clevis 221 which rotatably supports lift pulley 211, and which supports control actuator 223. Lift shaft 219 is attached at its other end to lift piston 225 of lift cylinder 227.

Lift cylinder 227 is connected at its end 229, through conduit 231, to fluid reservoir 233 and upstroke reversal accumulator 235, shown with its piston 239 and stop 237. Upstroke reversal valve 241, shown with its valve control 243, controls fluid flow to reservoir 233.

Lift cylinder 227 is connected at its end 245, through conduit 247, to balance accumulator 251 and downstroke reversal accumulator 253. Downstroke reversal valve 255, shown with its valve control 257, controls fluid flow to balance accumulator 251.

Support bar 259 forms a base for switches 261 and 267, which activate motor control 217, and switches 263 and 265, which activate valve controls 257 and 243, respectively.

Gear reduction unit 209's drive sprocket 207 is carded on its output shaft 208, and drives drive chain 203 in a linear manner. A low gear reduction ratio is therefore suitable, and can be furnished by an economical single reduction unit. Assuming that shaft 219, lift pulley 211, and control actuator 223 are moving from fight to left in FIG. 4, in the middle of pumping unit 4's upstroke, control actuator 223 then contacts switches 265 and 267, closing valve 241 and operating motor control 217 to de-energize motor 215. Pressure builds in upstroke reversal accumulator 235 to slow and stop the motion, and then to start motion in the downstroke direction.

Control actuator 223 then contacts switches 267 and 265, energizing motor 215 in the downstroke direction and opening valve 241. Motor 215 moves the assembly in the constant velocity portion of the down stroke until control actuator 223 contacts switches 263 and 261, closing downstroke reversal valve 255 and de-energizing motor 215, which continues to revolve with movement of the system as it slows, stops, and begins to move in the upstroke direction.

Control actuator 223 then contacts switches 261 and 263, activating motor 215 in the upstroke direction and opening valve 255. Motor 215 then moves the unit through the constant velocity portion of the upstroke, until control actuator 223 once again contacts switches 265 and 267.

Lift cylinder 227 functions first as a hydraulic pump and then as a hydraulic motor during each reversal, and in connection with its counterbalance function, as a pump during the downstroke and a motor during the upstroke. These functions of lift cylinder 227 are very similar to those of lift cylinder 25 of pumping unit 1, which were discussed in more detail earlier.

Figure 5:
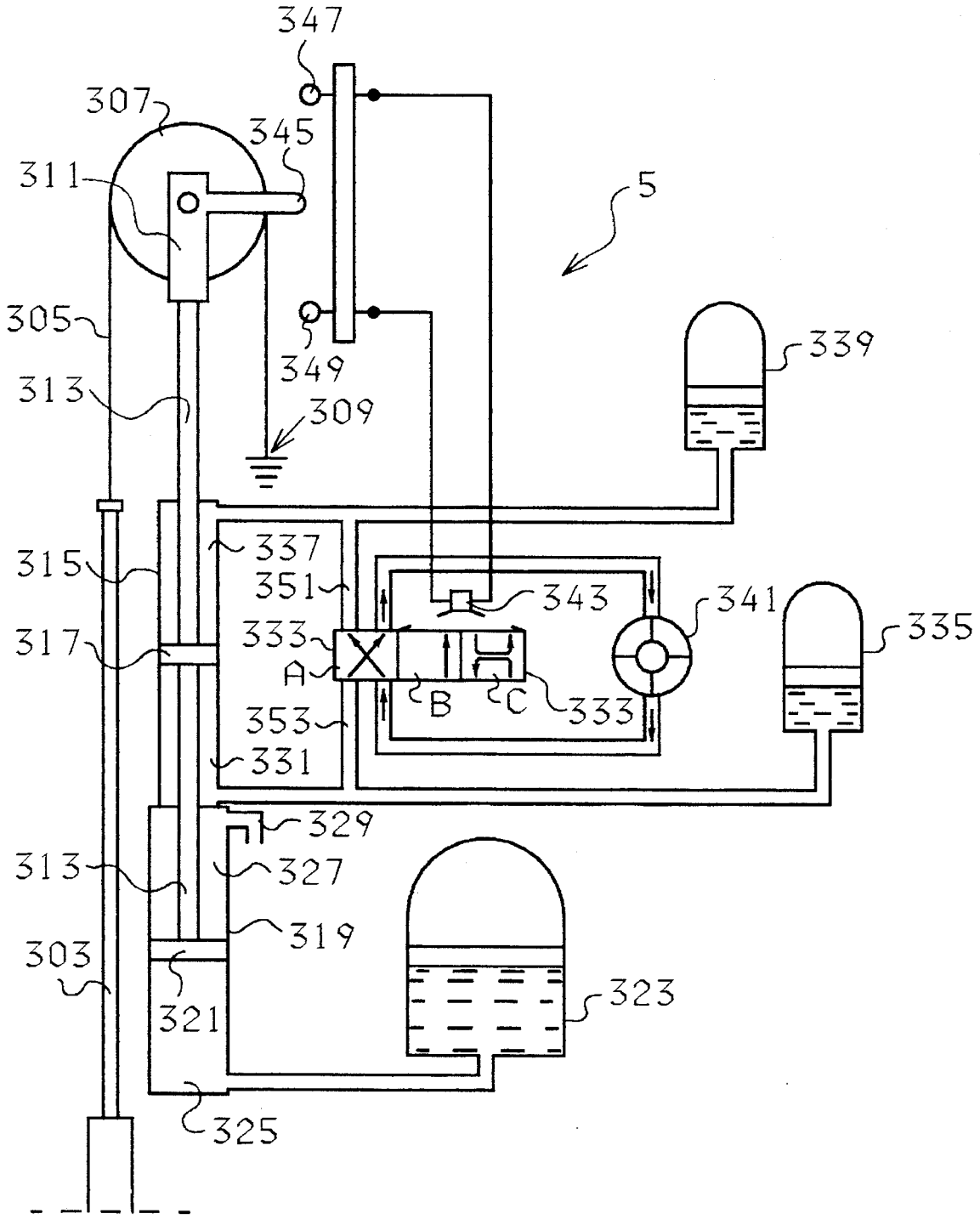
FIG. 5 is a schematic drawing of pumping unit 5, which comprises the subject stroke reversal system.

The embodiment of my stroke reversal invention shown in pumping unit 5, in FIG. 5, comprises hydraulic-pneumatic counterbalance and stroke reversal features, and is cycled by a single, three position hydraulic valve, which is operated as a function of the location of the shaft and pulley which supports the polish rod. The hydraulic stroke reversal circuit is integrated with the hydraulic drive circuit and both are controlled by the single hydraulic valve, above.

Referring to FIG. 5, polish rod 303 is supported by elongated flexible member 305, which is trained over support pulley 307 and secured to the framework at 309. Support pulley 307 is rotatably supported by clevis 311, which is attached to the upper end of support shaft 313.

Support shaft 313 is common to drive-reversal cylinder 315, supporting its piston 317, and balance cylinder 319, supporting its piston 321. Balance accumulator 323 is connected to lower chamber 325 of balance cylinder 319, and supplies an only slightly varying hydraulic pressure to the underside of piston 321 throughout the stroke cycle. Upper chamber 327 of balance cylinder 319 does not require fluid, and may be open to the atmosphere at aperture 329.

The lower chamber 331 of drive-reversal cylinder 315 is connected to valve 333 and to downstroke reversal accumulator 335. Upper chamber 337 of cylinder 315 is connected to an opposite outlet on valve 333 and to upstroke reversal accumulator 339. Hydraulic pump 341 operates constantly at a uniform output in one direction.

Valve 333 is switched among its three positions A, B, and C, by valve control 343, which is activated by engagement of activator 345 with contacts 347 and 349, respectively. In the A position shown in FIG. 5, valve 333 is directing fluid into upper chamber 337 of cylinder 315; piston 317 and support shaft 313 are moving downward, and pumping unit 5 is approximately in the center of its downstroke, moving at a constant velocity.

Toward the end of the downstroke, activator 345 engages contact 349 in a downward direction, which through valve control 343 switches valve 333 into its B position, in which no fluid is allowed to flow through valve 333 from or to conduits 351 and 353, and fluid from pump 341, which operates constantly, is re-circulated directly through valve 333.

Fluid which is being displaced by downward movement of piston 317, and had been passing through pump 341 and into upper chamber 337 of cylinder 315, must now flow into downstroke reversal accumulator 335. Pressure in accumulator 335 builds as its gas volume decreases, and this increasing pressure is applied to the lower chamber 331 of cylinder 315, and to the lower side of piston 317, which slows and stops the downward movement of the system.

The kinetic energy of the downward movement is stored in the pressurized gas of accumulator 335, and when movement stops this stored energy is returned to begin and accelerate movement in the upward direction. This stopping and reversing of motion comprises the downstroke reversal of pumping unit 5, at the end of which activator 345 engages contact 349 in an upward direction, which causes valve control 343 to switch valve 333 into its C position.

This causes pressurized fluid to apply to the bottom side of piston 317 in cylinder 315, and the larger, level velocity portion of the upstroke is effected. Activator 345 then engages, in the upward direction, contact 347, which switches valve 333 into its B position, causing displaced fluid to flow solely into upstroke reversal accumulator 339, and upstroke reversal occurs. The powered portion of the downstroke then occurs after activator 345 engages contact 347 in the downward direction, switching valve 333 into its A position.

Balance accumulator 323 is at least several times the size of balance cylinder 319, in order that its support pressure varies only slightly throughout the stroke cycle. Its gas pressure is adjusted to balance the weight of the rod string plus a portion of the weight of the fluid column, in order that approximately the same energy is required for the downstroke and the upstroke.

Reversal accumulators 335 and 339 are in direct opposition throughout the stroke cycle, including reversal. It is noted that the reversal buildup of gas pressure in one is offset by the declining gas pressure in the other as its volume increases. This characteristic is included in design calculations to determine maximum and minimum gas volumes for accumulators 335 and 339, along with the size and length of cylinder 315, stroke velocity, rod string weight, desired reversal characteristics, and selected fluid working pressure.

Drive-reversal cylinder 315 functions as a hydraulic motor during the powered portions of the upstroke and the downstroke, and as a hydraulic pump and then as a hydraulic motor during each reversal.

The subject embodiment of my stroke reversal invention is particularly advantageous in that it reduces even further the total number of major and minor components, and in that its operational cycle is totally controlled by the standard three-position hydraulic valve.

As has been explained in detail in connection with the previously described embodiments by my invention, the subject embodiment also exhibits the characteristic of automatically reversing the top and bottom of the rod string at the same instant, thereby eliminating parasitic rod string oscillation due to reversal.

Pumping unit 6 illustrates another embodiment of my stroke reversal invention, in which power is applied mechanically and directly to a rotating support shaft, counterbalance is mechanical and direct, and the stroke reversal force is applied hydraulicly and independently as a torque to the support shaft.

Figure 6:
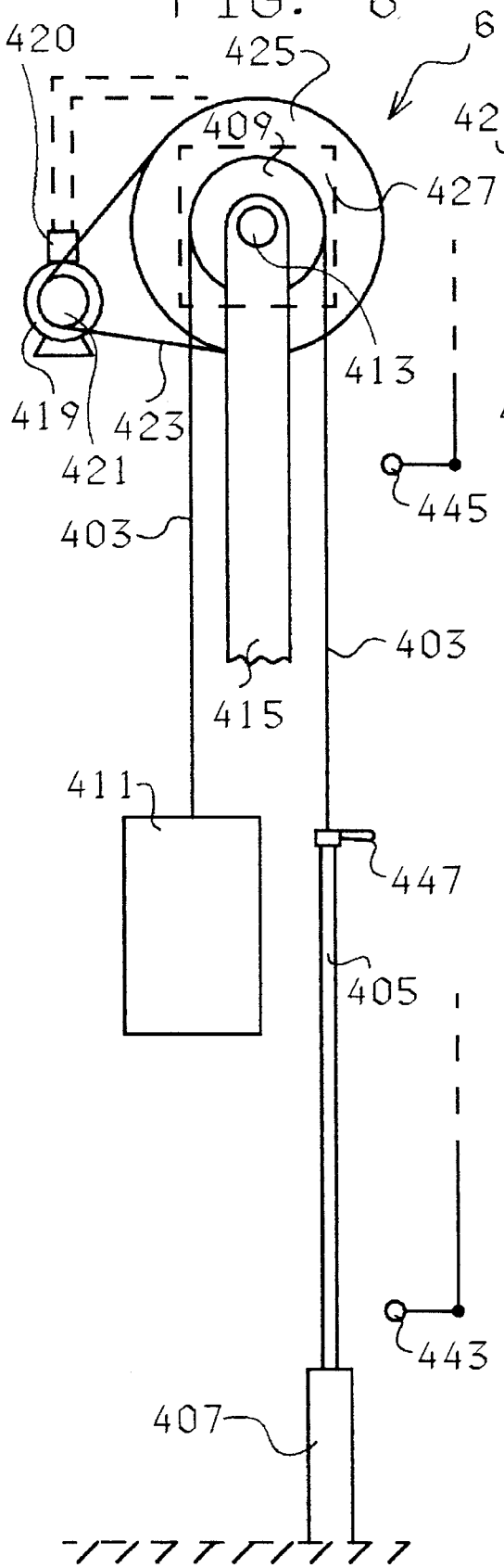
FIG. 6 is a schematic drawing of a side view of pumping unit 6, which comprises the subject stroke reversal system.
Figure 7:
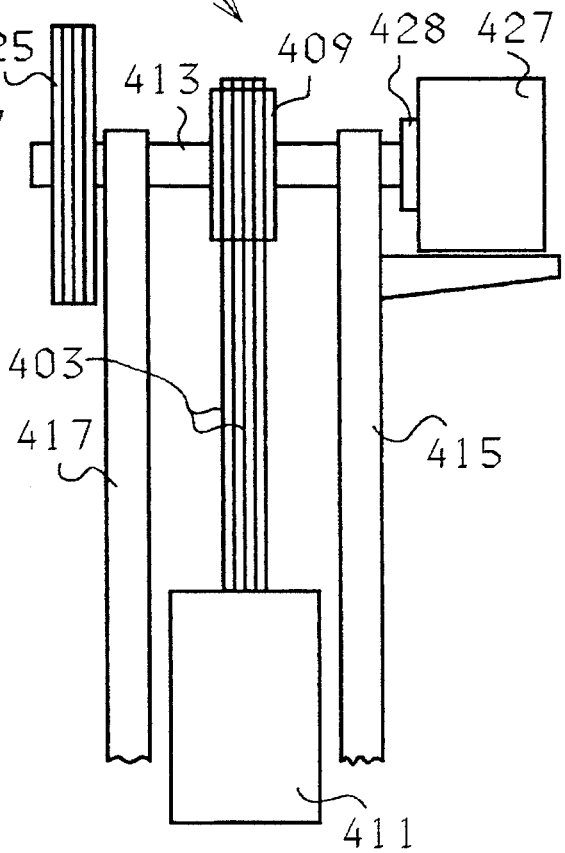
FIG. 7 is a schematic front view of pumping unit 6.
Figure 8:
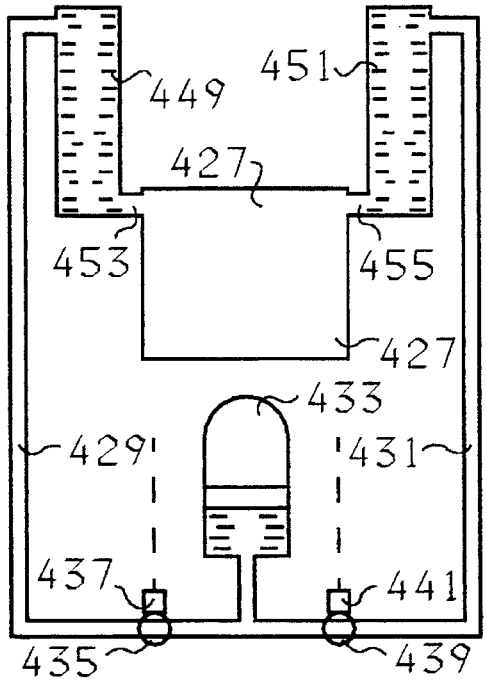
FIG. 8 is a schematic drawing of the hydraulic and hydraulic-pneumatic stroke reversal components of pumping unit 6.

Pumping unit 6 is shown in schematic form in FIGS. 6, 7 and 8. Flexible member 403 supports polish rod 405, enclosed by wellhead 407, at its one end, is trained over support sprocket 409 and supports at its other end counterweight 411.

Support sprocket 409 is attached to support shaft 413, which is rotatably supported by framework members 415 and 417 (refer to FIG. 7). Drive motor 419, through its drive pulley 421 and belts 423, rotates support shaft 413 and support sprocket 409 directly by means of support pulley 425.

Hydraulic pump-motor 427, shown in FIGS. 7 and 8 and in shadow form, for clarity, in FIG. 6, is supported by framework member 415, and its output member 428 is concentric with and rigidly connected to support shaft 413.

Referring to FIG. 8, fluid tanks 449 and 451 are respectively connected by large, short conduits 453 and 455 to the respective outlet apertures of pump-motor 427, and, together with conduits 429 and 431, form a loop, joining together and to reversal accumulator 433. Conduit 429 is fitted with valve 435 and its valve control 437, and conduit 431 is fitted with valve 439 and its control 441.

Control actuator 447 is carried by polish rod 405 and engages switch 443 in a downward direction at the end portion of the downstroke, and engages switch 443 again in an upward direction after the beginning of the upstroke. The period between these two contacts of switch 443 by control actuator 447 comprises the downstroke reversal of pumping unit 6.

Control actuator 447 later contacts switch 445 first in an upward direction and then in a downward direction, to define the upstroke reversal of pumping unit 6.

Counterweight 411 is heavy enough to balance the weight of the rod string plus a portion of the weight of the fluid column of the well, so that an approximately equal torque upon support shaft 413 and support sprocket 409 is required from drive motor 419 to drive pumping unit 6 during the upstroke and the downstroke.

Drive motor 419 is shown as directly connected by belts to rotate support shaft 413 and support sprocket 409 by means of support pulley 425, which is as large as practical. This direct connection is acceptable when the travel velocity of the rod string is relatively high, and the support requirements are low enough to allow a small diameter for support sprocket 409.

Flexible member 403 is possibly a roller chain, and its wear is a major consideration, increasing as the size of sprocket 409 decreases. Slower and heavier units will require a reduction drive which will not exceed the 6:1 ratio which is attainable with a single reduction gearbox.

Motor 419 is activated during the level velocity portions of the stroke, when control actuator 447 is between switches 443 and 445. During the reversal portions of the upstroke and the downstroke, when actuator 447 is below switch 443 or above switch 445, motor 419 is moved by the system but is not energized. Motor 419 is de-energized by its motor control 420, which is electrically or otherwise connected to switches 443 and 445, at the beginning of each reversal, and re-energized in the opposite direction at the end of each reversal by the second contact of actuator 447 with switch 443 or 445, respectively.

Pump-motor 427, which rotates with support shaft 413, rotates freely during the powered central portions of the upstroke and the downstroke, circulating its hydraulic fluid in respective opposite directions through the loop comprising fluid tank 449, conduit 429, conduit 431, and fluid tank 451, with valves 435 and 439 in the open position.

Reversal accumulator 433 exerts a pre-determined pressure into this hydraulic system during these portions of the pumping cycle, but it is equal on both sides of pump-motor 427, and causes no energy loss.

Valve control 437, attached to downstroke reversal valve 435, is connected to switch 443, and closes valve 435 when actuator 447 contacts switch 443 while moving downward. At the same time, motor 419 is deactivated by its control 420, which is also connected to switch 443, and motor 419 continues to move passively.

Fluid being circulated by pump-motor 427, because of the downward movement of the polish rod assembly and the associated rotation of support shaft 413, and which is moving downward in conduit 431, must now move into reversal accumulator 433.

Pump-motor 427 now begins to operate as a pump as it continues to rotate because of the inertia of the system and the resistance of the increasing gas pressure in reversal accumulator 433, moving fluid into reversal accumulator 433 as accumulator 433's gas volume decreases. The kinetic energy of the system is transformed into energy in the compressed gas, and movement slows and stops.

When movement ceases, pump-motor 427 begins to operate as a motor as the compressed gas forces fluid out of accumulator 433, upward through conduit 431, through fluid tank 451, and into pump-motor 427. Pumping unit 6 is thus caused to begin its upstroke, and when actuator 447 contacts switch 443 in the upward direction, valve 435 is opened, motor 419 is actuated in the reversed direction and initiates the level speed central portion of the upstroke.

During this powered portion of the upstroke, fluid is flowing freely through the above mentioned loop of conduits 429 and 431, fluid tanks 449 and 451, and pump-motor 427, and is flowing in an upward direction in conduit 431.

When control actuator 447 engages switch 445, motor 419 is deactivated, upstroke reversal valve 439 is closed, and the momentum of the system is accepted and stored as energy in the compressed gas of reversal accumulator 433, and movement is gradually halted. As before, movement is then initiated by the gas pressure forcing fluid through pump-motor 427, switch 445 is contacted during downward movement of actuator 447, valve 439 is opened, motor 419 is activated in the downstroke direction, and the powered portion of the downstroke ensues.

The embodiment of the invention incorporated in pumping unit 6, and illustrated in FIGS. 6, 7, and 8, utilizes a mechanical drive and a mechanical, dead-weight counterbalance. Hydraulic and hydraulic-pneumatic components are utilized for the stroke reversal functions only of pumping unit 6, which are isolated from the drive and counterbalance systems.

Fluid tanks 449 and 451 are elevated above, and connected to, pump-motor 427 by large, short conduits 453 and 455, respectively. Their function is to supply additional fluid within the closed system during reversals, when reversal accumulator 433 has more fluid forced into its lower chamber.

When valve 435 is closed and the momentum of the system causes pump-motor 427 to force fluid downward through conduit 431 into accumulator 433, pump-motor 427 pulls fluid from fluid tank 449 to continue operating. A vacuum is created in the upper end of tank 449 and the amount of fluid in it is reduced until motion of the system stops and reverses; the fluid then replaces the vacuum and valve 435 then is opened. A similar chain of events occurs at the upstroke reversal, in tank 451, when valve 439 is closed, then opened.

For ease of illustration, control actuator 447 is shown as supported by the connection of polish rod 405 and flexible support member 403, but this embodiment is not restrictive, as there are other methods of mounting the control actuator, the underlying requirement being that the respective switches are activated in response to the arrival of the mechanisms at particular respective locations in the stroke cycle.

For the sake of ease of illustration and description, the system is illustrated as having a single switching point at which the drive and reversal functions are switched at the beginning of, and at the end of, upstroke reversal, and respectively, downstroke reversal.

In actual practice, there will be applications in which the switching of the drive function will be separated from the point in the stroke cycle of the switching of the reversal function, and/or the switching of each function at the beginning of reversal will not coincide with its switching point along the stroke, at the end of reversal.

Figure 9:
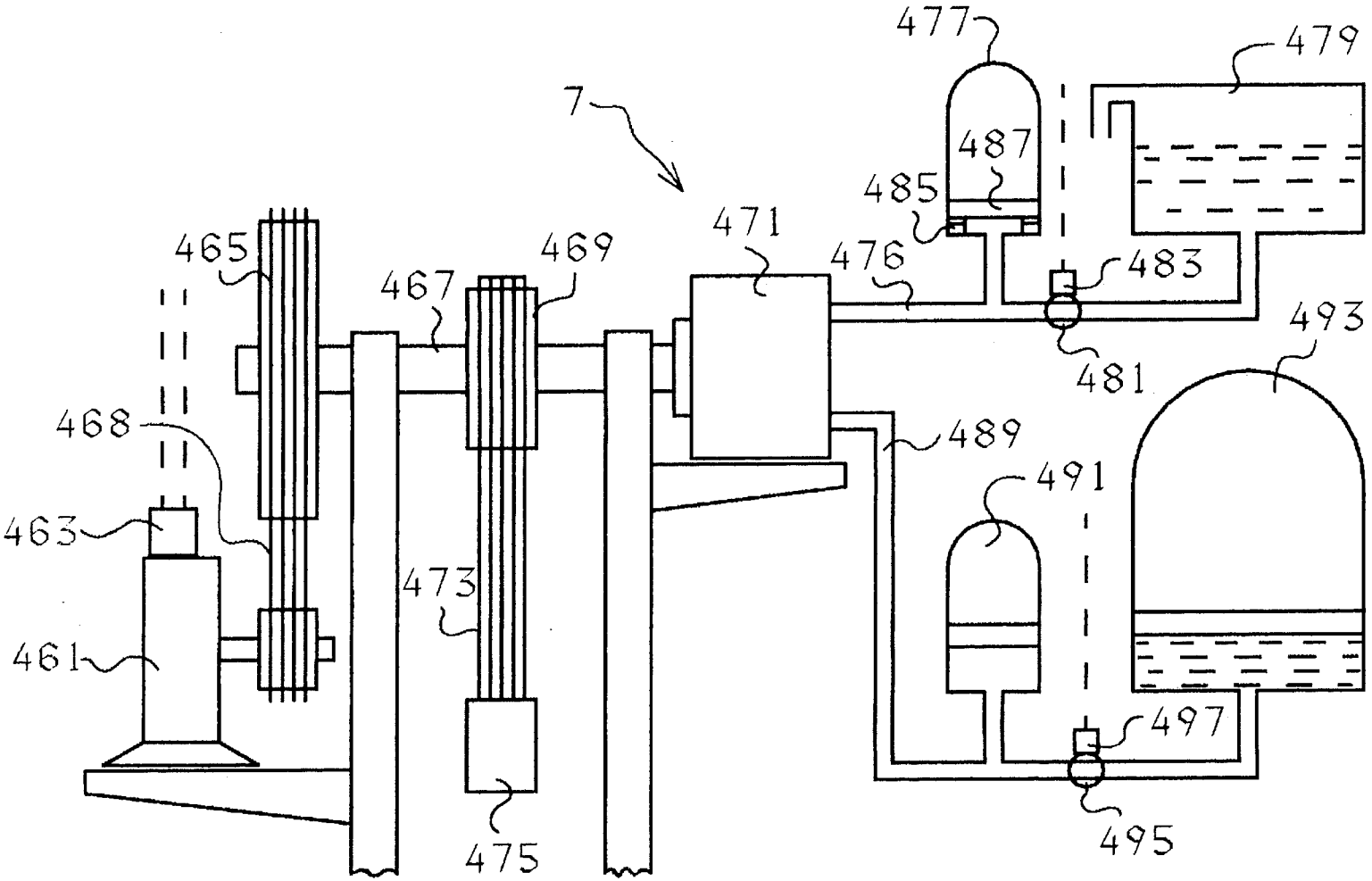
FIG. 9 is a schematic drawing of pumping unit 7, which comprises the subject stroke reversal system.

FIG. 9 is a schematic drawing of the application of the subject stroke reversal invention in pumping unit 7, which utilizes a mechanical drive with reversing motor 461 with control 463 driving, through belting 468, support pulley 465 on support shaft 467, which has attached support sprocket 469 and pump-motor 471. Flexible member 473 supports the polish rod assembly (not shown) on one side, and relatively small guide-weight 475, which stabilizes flexible member 473 on sprocket 469, on the other. Guide-weight 475 can be small enough that its weight is of little consequence as a counterweight.

It will be noted that the drive of pumping unit 7 is mechanical, and the two remaining major functions, counterbalance and stroke reversal, are interconnected and utilize hydraulic and hydraulic-pneumatic components.

One outlet of pump-motor 471 is connected by conduit 476 to upstroke reversal accumulator 477 and fluid reservoir 479, with valve 481, with its valve control 483, between the two, so that it can prevent the flow of fluid to or from fluid reservoir 479. Accumulator 477 may utilize a ring-shaped stop 485 for its piston 487 to rest against while valve 481 is open and no external pressure is being applied to accumulator 477.

The opposite outlet from pump-motor 471 is connected by way of conduit 489 to downstroke reversal accumulator 491 and balance accumulator 493, with valve 495 and its valve control 497 between the two, so that it can prevent the flow of fluid to or from balance accumulator 493.

Motor 461, through its control 463, and valves 481 and 495, through their respective controls 483 and 497, are operated in the same manner as the comparable motor 215 and valves 255 and 241 of pumping unit 4 of this invention, by means of a control actuator and switches located along the reciprocal path of the control actuator. For simplicity of illustration, and in view of the similarity of these components and their functions to those of pumping unit 4, these items are not shown in FIG. 9.

Motor 461 is a single speed reversible motor which operates during the long, level-velocity portion of the upstroke and the downstroke, and is passive and moved by the system during the two respective reversal portions of the stroke, as is motor 215 of pumping unit 4.

Balance accumulator 493 applies a balance force to one side of pump-motor unit 471 which translates into a torque on shaft 467 and sprocket 469 which is in a direction and amount sufficient to balance the weight of the polish rod assembly plus a portion of the weight of the fluid column of the well.

The size of accumulator 493 is such that this balance force changes little throughout the stroke cycle, and it is applied directly from accumulator 493 except during downstroke reversal, when valve 495 is closed. At this time the original force from accumulator 493 remains, and is increased by the varying downstroke reversal force from downstroke reversal accumulator 491, which is added during downstroke reversal. After downstroke reversal, valve 495 is once again open, and fluid moves directly between accumulator 493 and pump-motor 471.

It is noted that guide-weight 475 could well be made larger to carry a larger part of the counterbalance load, possibly up to the minimum design loading for a particular unit, with balance accumulator 493 supplying the remainder of balance force up to the maximum design load for the unit; adjustment of the force from accumulator 493 is easy to perform.

Fluid reservoir 479 is connected to the other, low pressure side of pump-motor 471, through conduit 476, and is maintained at atmospheric pressure, as shown, or a low pressure accumulator could be substituted. Upstroke reversal accumulator 477 serves best when its gas is under pressure at the beginning of reversal, so stop 485 is used to arrest movement of its piston 487 when accumulator 477 is not performing reversal.

Upstroke reversal is accomplished by the closing of valve 481, causing fluid moving into conduit 476 from the movement of the system to flow solely into accumulator 477. Gas pressure builds, absorbing the kinetic energy of movement, then movement is started in the downstroke direction by the expansion of the gas, followed by the opening of valve 481 and the powered portion of the downstroke.

During the powered, level velocity, central portions of the upstroke and the downstroke, fluid moves between balance accumulator 493 and fluid reservoir 479, through pump-motor 471. During downstroke reversal, valve 495 is closed and fluid moves between downstroke reversal accumulator 491 and fluid reservoir 479, through pump-motor 471. During upstroke reversal, valve 81 is closed and fluid moves between upstroke reversal accumulator 477 and balance accumulator 493, through pump-motor 471.

Pump-motor 471 functions as a motor during the powered portion of the upstroke, as a pump during the powered portion of the downstroke, and as a pump and then motor during each stroke reversal.

Figure 10:
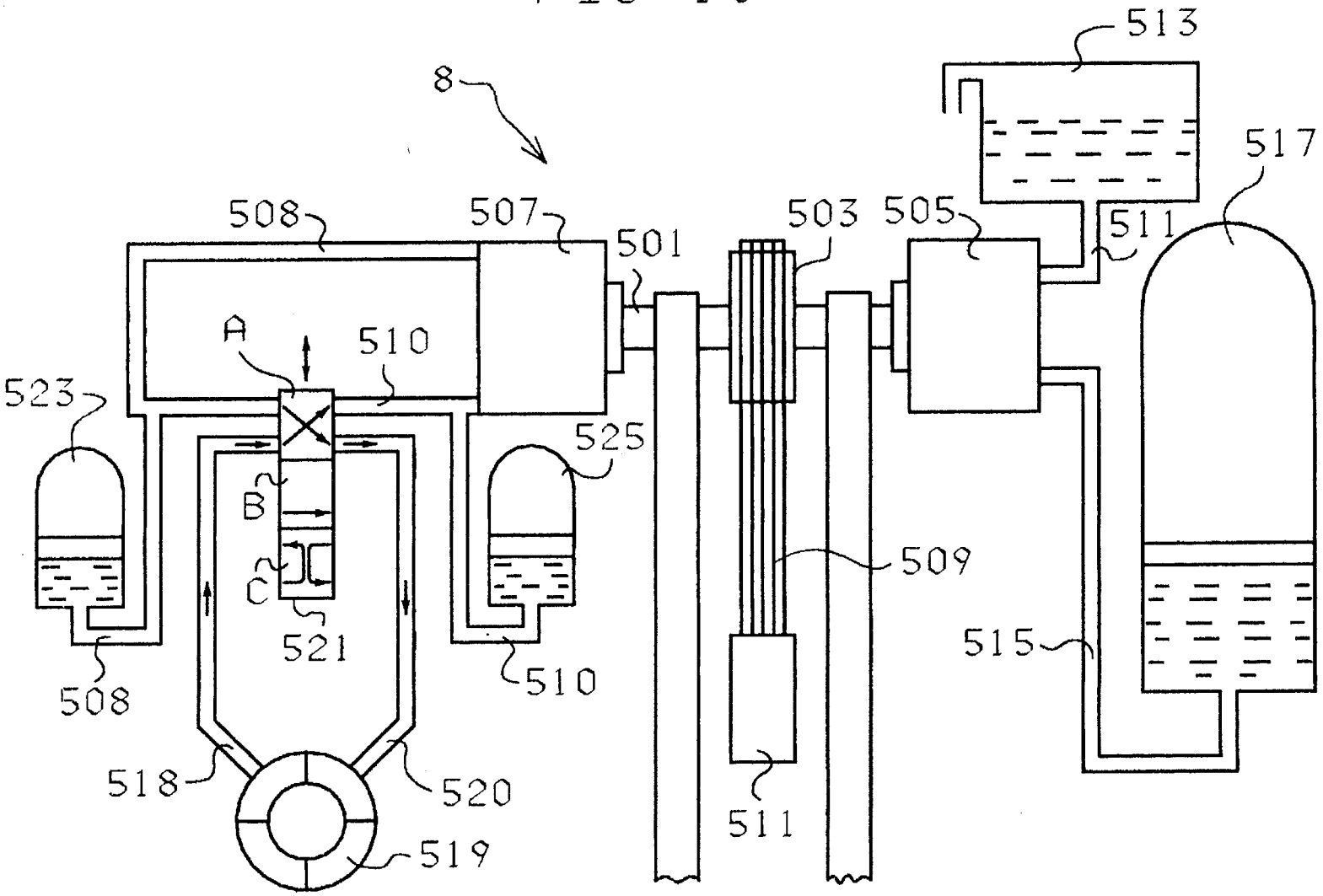
FIG. 10 is a schematic drawing of pumping unit 8, which comprises the subject stroke reversal system.

FIG. 10 is a schematic drawing of pumping unit 8, which comprises another embodiment of the subject invention. Pumping unit 8 uses hydraulic and/or hydraulic-pneumatic components for its three major functions: drive, counterbalance, and stroke reversal. Further, the entire stroke cycling control mechanism comprises one three-position hydraulic valve, which controls the combined reversal and drive circuits, and the drive motor runs constantly. The drive and reversal functions are hydraulicly interconnected, and the balance system is isolated.

Support shaft 501 carries support sprocket 503, and is coaxial with and connected to the output members of balance pump-motor 505 and drive-reversal pump-motor 507 at its respective ends. Support sprocket 503 carries flexible member 509 which supports at its respective ends guide-weight 511 and the polish rod assembly, which is not shown.

Balance pump-motor 505 turns with the movement of the system, and is connected to fluid reservoir 513 through conduit 511, and at its other outlet to balance accumulator 517 through conduit 515. Fluid from accumulator 517 flows to reservoir 513 during the entire upstroke, moving through pump-motor 505 and causing it to function as a motor and, along with the additional smaller drive torque exerted upon shaft 501 by drive-reversal pump-motor 507, raising the polish rod assembly and the fluid column.

During the entire downstroke, pump-motor 505 functions as a pump, forcibly moving fluid from fluid reservoir 513 into balance accumulator 517, further compressing its contained gas to store the energy from the descending polish rod assembly along with a portion of the drive energy put into the system during the downstroke by drive-reversal pump-motor 507.

Simply stated, balance accumulator 517 exerts a constant torque of an almost constant value on support shaft 501, functioning as a resilient counterbalance to the approximate weight of the rod string plus a portion of the weight of the fluid column.

Hydraulic pump 519 is driven by an electric motor (not shown), or otherwise, and operates constantly in one direction when pumping unit 8 is functioning, and can be a single speed, constant output pump. Its output is into conduit 518, and its return is by conduit 520, as indicated by arrows in FIG. 10.

Conduits 518 and 520 are connected to three position hydraulic valve 521. Drive-reversal pump-motor 507 is connected at one of its outlets by means of conduit 508 to upstroke reversal accumulator 523 and to valve 521, and at its other outlet by conduit 510 to downstroke reversal accumulator 525 and to an opposite outlet on valve 521.

Valve 521 is shown in FIG. 10 in its "A" position for the powered portion of the upstroke of pumping unit 8; fluid under pressure from hydraulic pump 519 is passing through conduit 518, through valve 521, through a portion of conduit 510 and into drive-reversal pump-motor 507, which rotates shaft 501 and sprocket 503 in the upstroke direction. Fluid returns from pump-motor 507, through portions of conduit 508 to valve 521, and through conduit 520 to return to pump 519.

Pumping unit 8 has a control actuator which can be similar to control actuator 447 of pumping unit 6, and an upstroke reversal switch and a downstroke reversal switch which can be very similar to switches 445 and 443, respectively, of pumping unit 6, and which are not shown in pumping unit 8 in the interest of clarity and brevity inasmuch as the function of the switches of these two respective pumping units are identical in most ways, with the notable exception that two valves and a motor control are actuated in pumping unit 6, and only a single valve in pumping unit 8 is actuated at the identical points in the pumping cycle.

At the end of the level speed powered portion of the upstroke, valve 521 is shifted into its central, "B" position by actions of the components discussed in the paragraph above. The upstroke reversal portion of the stroke cycle is begun, and fluid expelled by pump 519 into conduit 518 now flows through conduit 518, directly through valve 521 to conduit 520 and returns to pump 519. There is an extremely small resistance to this circulation of fluid, and very little energy is consumed by pump 119 during this stroke reversal phase.

During this positioning of valve 521 in its "B" position, fluid is prevented from flowing between conduit 508 and valve 521, and between conduit 510 and valve 521. Fluid from pump-motor 507, which is still turning and now operating as a pump because of upward inertia of the still-moving system, must now enter upstroke reversal accumulator 523.

The compressed gas of accumulator 523 is further compressed, slowing and stopping movement of the system. When the system has stopped moving, the compressed gas returns the stored energy by forcing fluid back through conduit 508 and into pump-motor 507, causing it to function as a hydraulic motor to begin movement in the downstroke direction.

At the end of the upstroke reversal phase, valve 521 is switched into its "C" position, in which fluid from pump 5 19 travels through conduit 518, through valve 521, into conduit 508, into pump-motor 507 to power the downstroke, and into conduit 510, valve 521, and back to pump 519 through conduit 520.

At the end of the powered portion of the downstroke, valve 521 is switched again into its "B" position for the downstroke reversal phase of the stroke. Pump 519 again re-circulates fluid directly through valve 521, fluid which was flowing from pump-motor 507 through conduit 510 and back to pump 519, must now flow through conduit 510 and to downstroke reversal accumulator 525.

Pump-motor 507 again acts first as a pump to move fluid into accumulator 525 and compress its gas, and then as a motor to receive the fluid, after motion of the system has stopped, to begin and accelerate the system in the upstroke direction.

At the end of the downstroke reversal phase of the cycle, valve 521 is switched again into it "A" position for the powered portion of the upstroke. It should be noted that the increasing gas pressure, during the first half of stroke reversal, in either accumulator 523 or 525, is countered by a decreasing gas pressure in the other, thereby partly nullifying its effect, and changing its force application characteristics. This phenomenon must be accounted for in selecting the size, pressure, and other characteristics of accumulators 523 and 525.

Although several embodiments of the pumping unit of the present invention have been described, those skilled in the art will recognize that various substitutions, rearrangements, and modifications may be made to these embodiments without departing from the scope and spirit of this invention as recited in the appended claims.

I claim:

1. A surface mounted pumping unit which comprises: counterbalance means; linear drive means; vertically reciprocating polish rod assembly including a polish rod, rod string, and downhole pump; elongated flexible means, trained over supporting pulley means and attached to said polish rod;

the improvement in combination therewith including a stroke reversal system which comprises:

bi-directional, positive displacement hydraulic reversal pump-motor means, its working mechanical components at least indirectly connected to, and moving reciprocally with said flexible means and said polish rod assembly;

hydraulic reversal circuitry operatively connected to said reversal pump-motor means, said circuitry containing reversal valve means having first and second valve means, said reversal valve means connected to a resilient hydraulic-pneumatic stroke reversal means;

said reversal pump-motor means arranged to function as a pump to cause circulation of fluid within said reversal circuitry when movement of said mechanical components of said pump-motor means is forced by said drive means and by the inertia of said pumping unit and said polish rod assembly;

said reversal pump-motor means further arranged to alternatively function as a motor to force the movement of said flexible means and said polish rod assembly in response to the forcing of circulation of said fluid in said reversal circuitry by hydraulic pressure from said stroke reversal means valve control means arranged to effect said reversal valve means so as to close said first valve means before the end of each downstroke and to open said first valve means after the beginning of the succeeding upstroke, and to close said second valve means before the end of each upstroke and to open said second valve means after the beginning of the succeeding downstroke;

said closing of said first and second valve means resulting in the direction of the total flow of said hydraulic fluid in said reversal circuitry to said stroke reversal means, and subsequently, from said stroke reversal means;

said flow of said fluid to said stroke reversal means caused by said inertia of the ending stroke, results in the storage of the kinetic energy of said ending stroke in the pressurized gas of said stroke reversal means;

said subsequent flow of said fluid from said stroke reversal means caused by said pressurized gas within said stroke reversal means is applied to the beginning of said next succeeding stroke.

2. The pumping unit of claim 1 in which said counterbalance means comprises hydraulic-pneumatic accumulator means.

3. The pumping unit of claim 1, in which said counterbalance means comprises mechanical counterweight means.

4. The pumping unit of claim 1, in which said hydraulic pump-motor means comprises hydraulic cylinder means.

5. The pumping unit of claim 1, in which said hydraulic pump-motor means comprises rotary hydraulic pump-motor means.

6. The pumping unit of claim 1, in which said resilient hydraulic-pneumatic stroke reversal means comprises at least one hydraulic-pneumatic accumulator.

7. The pumping unit of claim 1, in which said linear drive means comprises bi-directional hydraulic cylinder means.

8. The pumping unit of claim 1, in which said elongated flexible means comprises drive chain means, said supporting pulley means comprises drive sprocket means, and said drive means comprises bi-directional rotary hydraulic pump-motor means arranged to rotate said drive sprocket means.

9. The pumping unit of claims 1, in which said elongated flexible means comprises drive chain means, said linear drive means comprises mechanically driven drive sprocket means in operable contact with said drive chain means.

10. The pumping unit of claim 1, in which said elongated flexible means comprises drive chain means, said support pulley means comprises mechanically actuated drive sprocket means.

11. The pumping unit of claim 1, in which said counterbalance means comprises hydraulic-pneumatic means, the hydraulic circuitry of which is integrated with said hydraulic system of said hydraulic reversal pump-motor means and said stroke reversal means.

12. The pumping unit of claim 1, in which said drive means is hydraulicly powered, its hydraulic circuitry integrated with said hydraulic system of said hydraulic reversal pump-motor means and said stroke reversal means.

13. The pumping unit of claim 1, in which said drive means is hydraulicly powered; said counterbalance means comprises hydraulic-pneumatic accumulator means; and each of their respective hydraulic systems is separate and isolated.

14. The pumping unit of claim 1, in which said hydraulic-pneumatic stroke reversal means comprises downstroke reversal accumulator means and upstroke reversal accumulator means; said counterbalance means comprises hydraulic-pneumatic counterbalance accumulator means; said downstroke reversal accumulator means and said counterbalance accumulator means share a common first, hydraulic circuit which is in opposition to a second, separate hydraulic circuit which comprises said upstroke reversal accumulator and fluid reservoir means.

15. The pumping unit of claim 14, in which said first and second opposing circuits are separated by a third, separate, hydraulic circuit.

16. The pumping unit of claim 1, in which said counterbalance means comprises a mechanical counterweight, and said linear drive means comprises a reversible, mechanically connected electric motor.

17. In a surface mounted pumping unit which comprises: counterbalance means; linear drive means; vertically reciprocating polish rod assembly including a polish rod, rod string, and downhhole pump; an elongated flexible tension member, trained over supporting pulley means and attached at its first end to said polish rod;

the improvement in combination therewith including a stroke reversal system comprising:

said counterbalance means arranged to at least indirectly apply an only slightly varying balance force to said flexible member throughout at least the major portion of the stroke cycle of said pumping unit, said balance force applied in a direction and in a magnitude to offset the weight of said polish rod assembly pins a portion of the weight of the fluid column of said well;

said linear drive means arranged to transfer a drive force to said flexible member during a substantial central portion of the upstroke and of the downstroke, respectively, of said pumping unit, said drive means further arranged for passive movement, causing minimal resistance to movement of said elongated flexible member during the remaining, reversal portions of said upstroke and said downstroke;

drive control means to de-activate said drive means near the end of each said upstroke and each said downstroke, respectively, and to re-activate said drive means in a reversed direction after the beginning of each respective successive stroke, the respective functions of said drive control means initiated in response to the arrival of said polish rod assembly at pre-selected respective locations along its reciprocal, vertical path;

bi-directional, positive displacement hydraulic reversal pump-motor means, its working mechanical components at least indirectly connected to, and moving reciprocally with said polish rod assembly and said flexible member, said reversal pump-motor means arranged to cause circulation of hydraulic fluid within a connected hydraulic system when movement of its said mechanical components is externally forced, and alternatively, to force the movement of said flexible member in response to the externally forced circulation of said fluid in said hydraulic system;

resilient hydraulic-pneumatic stroke reversal means operably situated within said hydraulic system, and arranged to accept input of said fluid under an increasing external pressure, and to expel said fluid under a decreasing external pressure;

reversal valve means situated within said hydraulic system, and arranged for intermittent closure, said closure resulting in the direction of the total flow of said fluid to, and alternatively, from said stroke reversal means;

valve control means to operate said reversal valve means near the end of each said upstroke and each said downstroke, respectively, and to operate said reversal valve means after the beginning of each respective successive stroke, the respective functions of said valve control means initiated in response to the arrival of said polish rod assembly at preselected respective locations along its said reciprocal, vertical path.

18. The pumping unit of claim 17, in which at least one of said stroke reversal system, said drive means, and said counterbalance means, comprises vertically aligned hydraulic cylinder means;

said supporting pulley means is rotatably attached to, and travels vertically with, a lift shaft which comprises the output shaft common to at least one of said stroke reversal, drive, and counterbalance cylinder means;

the second end of said elongated flexible tension member joined to framework means.

19. The pumping unit of claim 17, in which said supporting pulley means comprises sprocket means carried upon a support shaft which is rotatably attached to framework means, said flexible member comprises drive chain means which attaches at its second end to at least minimal counterweight means, said drive and stroke reversal forces of said pumping unit transferred to said drive chain means by way of torque introduced into said support shaft.

20. The pumping unit of claim 19, in which said drive means comprises reversible electric motor means directly connected by belting to sheave means mounted upon said support shaft.

21. The pumping unit of claim 19, in which said hydraulic pump-motor means comprises rotary hydraulic pump-motor means, its mechanical output-input means connected to, and rotating with, said support shaft; the two hydraulic outlets of said pump-motor means each connected to respective conduit means, each of which is connected to a stroke reversal valve, said conduits then connecting together and to resilient hydraulic-pneumatic stroke reversal accumulator means.

* * * * *